US009751599B1

(12) United States Patent
Ebrahimi

(10) Patent No.: US 9,751,599 B1
(45) Date of Patent: Sep. 5, 2017

(54) STANDUP PADDLEBOARD

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 0 days.

(21) Appl. No.: 15/096,103

(22) Filed: Apr. 11, 2016

Related U.S. Application Data

(60) Provisional application No. 62/145,358, filed on Apr. 9, 2015.

(51) Int. Cl.
*B63B 35/81* (2006.01)
*B63B 35/79* (2006.01)

(52) U.S. Cl.
CPC ..... *B63B 35/7916* (2013.01); *B63B 35/7913* (2013.01); *B63B 35/7926* (2013.01)

(58) Field of Classification Search
CPC ..... B63B 35/7916; B63B 35/7913; B63B 35/7926; B63B 35/83
See application file for complete search history.

(56) References Cited

U.S. PATENT DOCUMENTS 3,585,664 A * 6/1971 Thompson ..... B63B 35/85 280/14.21
3,609,782 A * 10/1971 Mabuchi ..... B63H 16/08 441/76
4,951,960 A * 8/1990 Sadler ..... B62B 15/00 280/14.22

* cited by examiner

*Primary Examiner* — Stephen Avila
(74) *Attorney, Agent, or Firm* — Plager Schack LLP

(57) ABSTRACT

A hull assembly is configured to transport a human user in water. The hull assembly includes a bow, having a bow concave portion. A port hull is joined to the bow. The port hull is adopted to accommodate a first foot of a human user. A starboard hull is joined to the bow and offset from the port hull by the bow concave portion. The starboard hull is adapted to accommodate a second foot of the human user. When a first port hull weight varies from a second port hull weight, the first port hull vertically deflects relative to the second port hull to increase the balance and stability of the human user and increase maneuverability of the vessel.

15 Claims, 6 Drawing Sheets

STANDUP PADDLEBOARD

RELATED APPLICATION

This application claims priority to provisional patent application U.S. Ser. No. 62/145,358 filed on Apr. 9, 2015, the entire contents of which is herein incorporated by reference.

BACKGROUND

The embodiments herein relate generally to vessel hull shape and assembly.

Prior to embodiments of the disclosed invention, a rigid single hull, inflatable or hard material, stand up paddle board when on water required constant adjustments in the participant's center of balance to maintain optimal bipedal posture aligned in its horizontal gravitational vector. The rapidly shifting center of balance was a challenge to correct because there was a constant and abrupt leaning (heeling) angle that was greatly amplified because the standup paddleboard is one fixed surface. As a biped that utilizes two legs, hips, knees and ankles to maintain its balance standing on this single abruptly leaning surface was much more difficult than being on two independently moving surfaces.

There have been many attempts to create two independent hulls under each foot. The other designs have suffered because on some your feet are either connected to the hulls or recessed in the hulls which is extremely dangerous and or the connection between the two hulls lacks the specific connection design to prevent the inner or outer rail edges from flipping/flipping in or out causing the person to slip off or between the two hulls and some of the connections suggested are of non-elastic material such as a chain. Many of the previous designs had the feet connected or recessed in part to compensate for the instability of the two hulls because the hulls were not properly connected meaning they did not solve the problem of the two hull surfaces from folding/flipping in or out which would cause the user to slip off or between the two hulls. Also, if a person's foot was connected to the hulls or recessed in the hulls and they fall their risk of drowning or injury was greatly increased.

Embodiments of disclosed invention solve, at least, these problems.

SUMMARY

A hull assembly is configured to transport a human user in water. The hull assembly includes a bow, having a bow concave portion. A port hull is joined to the bow. The port hull is adopted to accommodate a first foot of a human user. A starboard hull is joined to the bow and offset from the port hull by the bow concave portion. The starboard hull is adapted to accommodate a second foot of the human user. When a first port hull weight varies from a second port hull weight, the first port hull vertically deflects relative to the second port hull. On each hull, at the port bow concave portion there is very little deflection and there is more deflection moving further aft in a manner similar to cantilever loading. A user has the ability to choose port to starboard and vertical movement intensity simply by adjusting one's stance position. By modifying stance position and increasing the cantilever intensity the hull now weighted acts like an aileron on an airplane, slow that side down, the other hull keeps moving fast, thus turning the board at an accelerated pace.

In some embodiments, the bow can further comprise a generally triangular shaped forward portion which is rounded on a port bow and a starboard bow while flat on a bow deck and a bow bottom side. The bow can be attached to a bow forward d-ring, a bow forward port first d-ring, a bow forward port second d-ring, a bow forward starboard first d-ring, a bow forward starboard second d-ring, a bow handle, and a bow concave portion d-ring.

In some embodiments, the port hull can further comprise a port hull port side, extending from the port bow. A port hull aft side can extend from the port hull port side. A port hull amidships side can extend from the port hull aft side. The port hull amidships side can be smoothly joined to the bow concave portion. The port bow can include a port hull top side and a port hull bottom side. A port hull amidships handle, a port hull aft handle, a port hull fill port and a port hull deck can be attached to the port hull top side. A port hull bottom side inboard fin and a port hull bottom side outboard fin can be attached to the port hull bottom side.

In some embodiments, the bow can further comprise a generally triangular shaped forward portion which is rounded on a starboard bow and a starboard bow while flat on a bow deck and a bow bottom side. The bow can be attached to a bow forward d-ring, a bow forward starboard first d-ring, a bow forward starboard second d-ring, a bow forward starboard first d-ring, a bow forward starboard second d-ring, a bow handle, and a bow concave portion d-ring.

In some embodiments, the starboard hull can further comprise a starboard hull starboard side, extending from the starboard bow. A starboard hull aft side can extend from the starboard hull starboard side. A starboard hull amidships side can extend from the starboard hull aft side. The starboard hull amidships side cam be smoothly joined to the bow concave portion. The starboard bow can include a starboard hull top side and a starboard hull bottom side. A starboard hull amidships handle, a starboard hull aft handle, a starboard hull fill starboard and a starboard hull deck can be attached to the starboard hull top side. A starboard hull bottom side inboard fin and a starboard hull bottom side outboard fin can be attached to the starboard hull bottom side.

In some embodiments, port hull water can fill the port hull through the port hull fill port. Starboard hull water can fill the starboard hull through the starboard hull fill port. In some embodiments, the hulls can be filled with pressurized air through the fill ports.

In some embodiments, an upper port hull grommet flap and a lower port hull grommet flap can be attached to the port hull amidships side. An upper starboard hull grommet flap and a lower starboard hull grommet flap can be attached to the starboard hull amidships side. An upper hull string can be connected to the upper port hull grommet flap and the upper starboard hull grommet flap. A lower hull string can be connected to the lower port hull grommet flap and the lower starboard hull grommet flap. This arrangement gives the rider the option to adjust the amount of movement between hulls. In some embodiments a tube can be inserted between the upper port hull grommet flap, the upper starboard hull grommet flap, the lower port hull grommet flap and the lower starboard hull grommet flap.

In some embodiments, a port hull upper amidships D-ring and a port hull lower amidships D-ring can be attached to the port hull. A starboard hull upper amidships D-ring and a starboard hull lower amidships D-ring, can be attached to the starboard hull. A upper connection member can be joined to the port hull upper amidships D-ring and the port hull lower amidships D-ring. A lower connection member can be joined to the starboard hull upper amidships D-ring, and the starboard hull lower amidships D-ring. This arrangement gives the rider the option to adjust the amount of movement between hulls.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
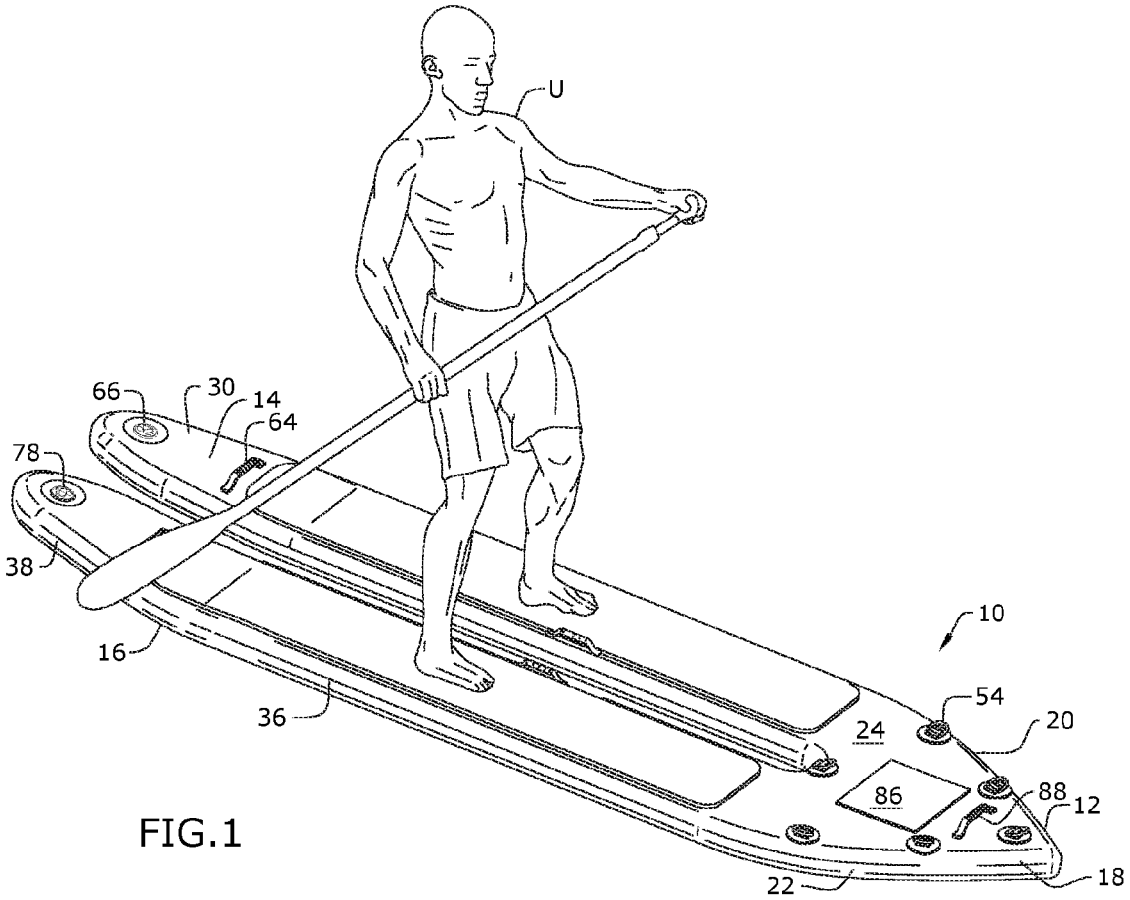
FIG. 1 shows a perspective view of one embodiment of the present invention shown in use.
Figure 2:
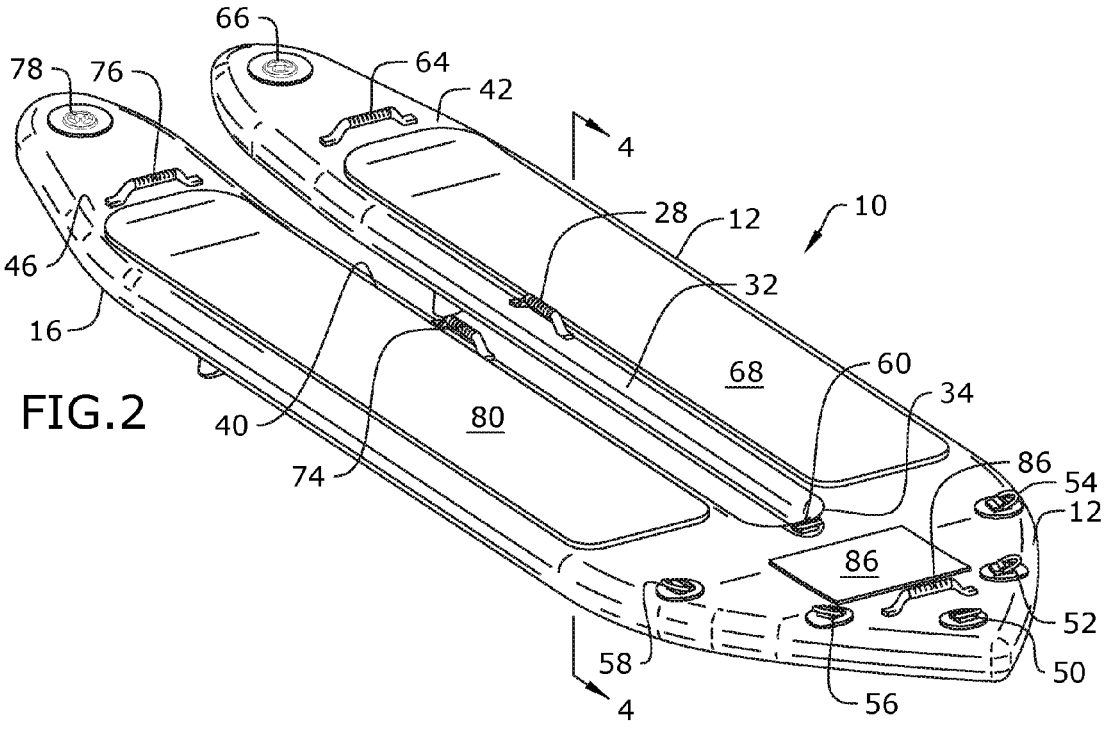
FIG. 2 shows a top perspective view of one embodiment of the present invention.
Figure 3:
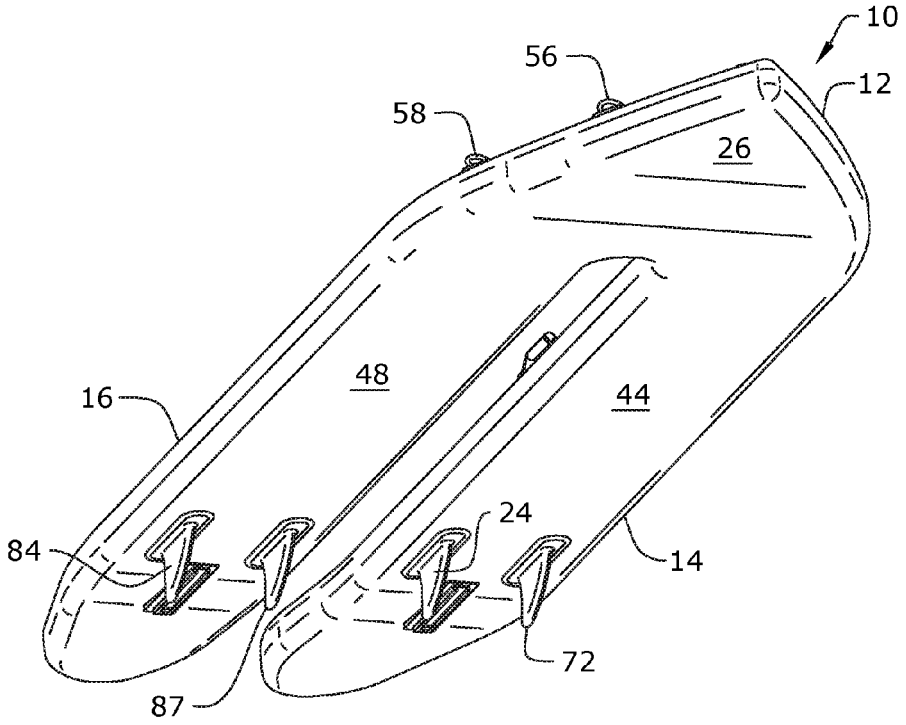
FIG. 3 shows a bottom perspective view of one embodiment of the present invention.

By way of example, and referring to FIG. 1, one embodiment of hull assembly 10 comprises bow 12 directly connected to port hull 14 and starboard hull 16. Bow 10 further comprises a generally triangular shaped forward portion which is rounded on port bow 20 and starboard bow 22 while flat on bow deck 24 and bow bottom side 26.

Port bow 20 extends aft to port hull port side 28. Port hull port side 28 is smoothly joined to port hull aft side 30. Port hull aft side 30 is smoothly joined to port hull amidships side 32. Port hull amidships side 32 is smoothly joined to bow concave portion 34.

Starboard bow 22 extends aft to starboard hull starboard side 36. Starboard hull starboard side 36 is smoothly joined to starboard hull aft side 38. Starboard hull aft side 38 is smoothly joined to starboard hull amidships side 40. Starboard hull amidships side 40 is smoothly joined to bow concave portion 34.

Port hull 14 further comprises port hull top side 42 and port hull bottom side 44. Starboard hull 16 further comprises starboard hull top side 46 and starboard hull bottom side 48.

Bow 10 is attached to bow forward d-ring 50, bow forward port first d-ring 52, bow forward port second d-ring 54, bow forward starboard first d-ring 56, bow forward starboard second d-ring 58, and bow concave portion d-ring 60.

Port hull top side 42 is connected to port hull amidships handle 62, port hull aft handle 64, port hull fill port 66 and port hull deck 68. Port hull bottom side 44 is attached to port hull bottom side inboard fin 70 and port hull bottom side outboard fin 72.

Starboard hull top side 46 is connected to starboard hull amidships handle 74, starboard hull aft handle 76, starboard hull fill port 78 and starboard hull deck 80. Starboard hull bottom side 48 is attached to starboard hull bottom side inboard fin 82 and starboard hull bottom side outboard fin 84. In some embodiments, hull identifying information can be located at information location 86. In some embodiments bow 12 can be attached to bow handle 88.

Figure 4:
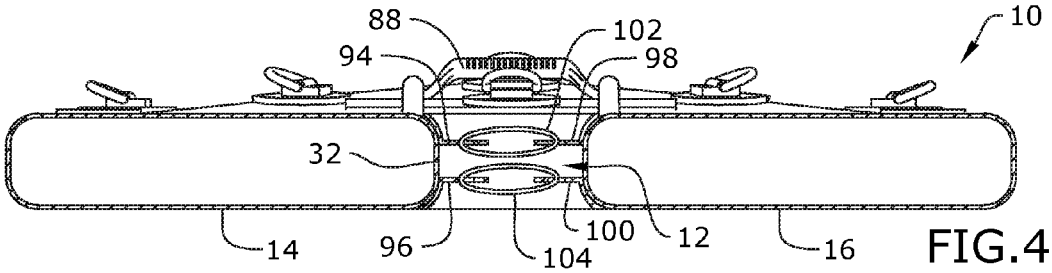
FIG. 4 shows a section view of one embodiment of the present invention.
Figure 5:
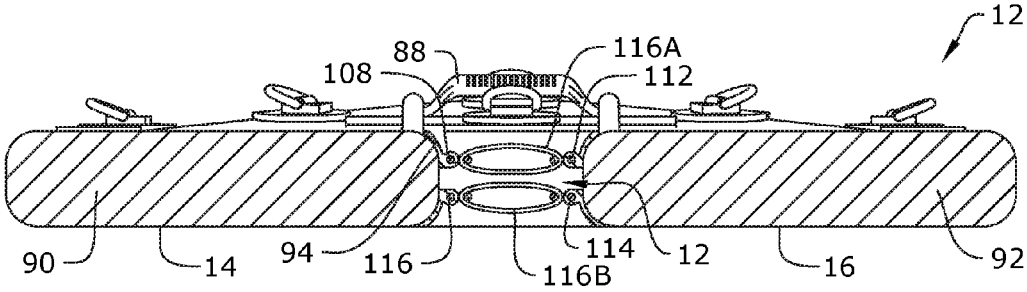
FIG. 5 shows a perspective view of one embodiment of the present invention.
Figure 6:
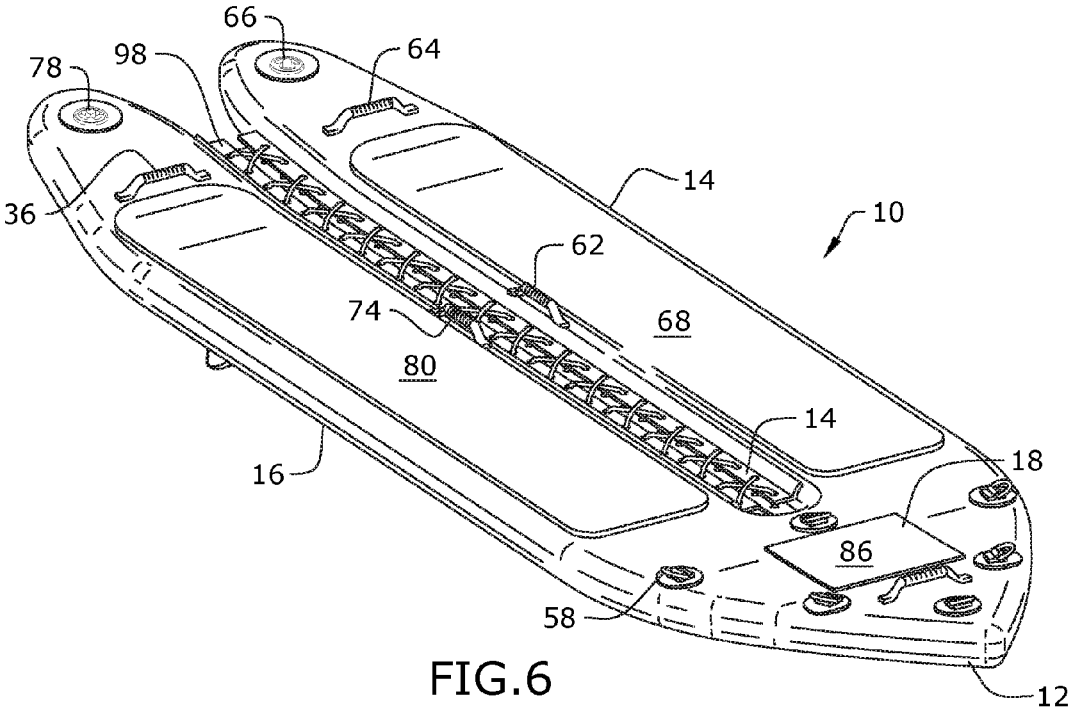
FIG. 6 shows a top perspective view of one embodiment of the present invention.

Turning to FIG. 4, FIG. 5 and FIG. 6 in some embodiments, port hull 14 can be filled with port hull water 90 through port hull fill port 66. Starboard hull 16 can be filled with starboard hull water 92 through starboard hull fill port 78. In some embodiments, port hull 14 can be inflatable and port hull fill port 66 can be used to insert compressed air into port hull 14. In some embodiments, starboard hull 16 can be inflatable and starboard hull fill port 78 can be used to insert compressed air into starboard hull 16.

Figure 7:
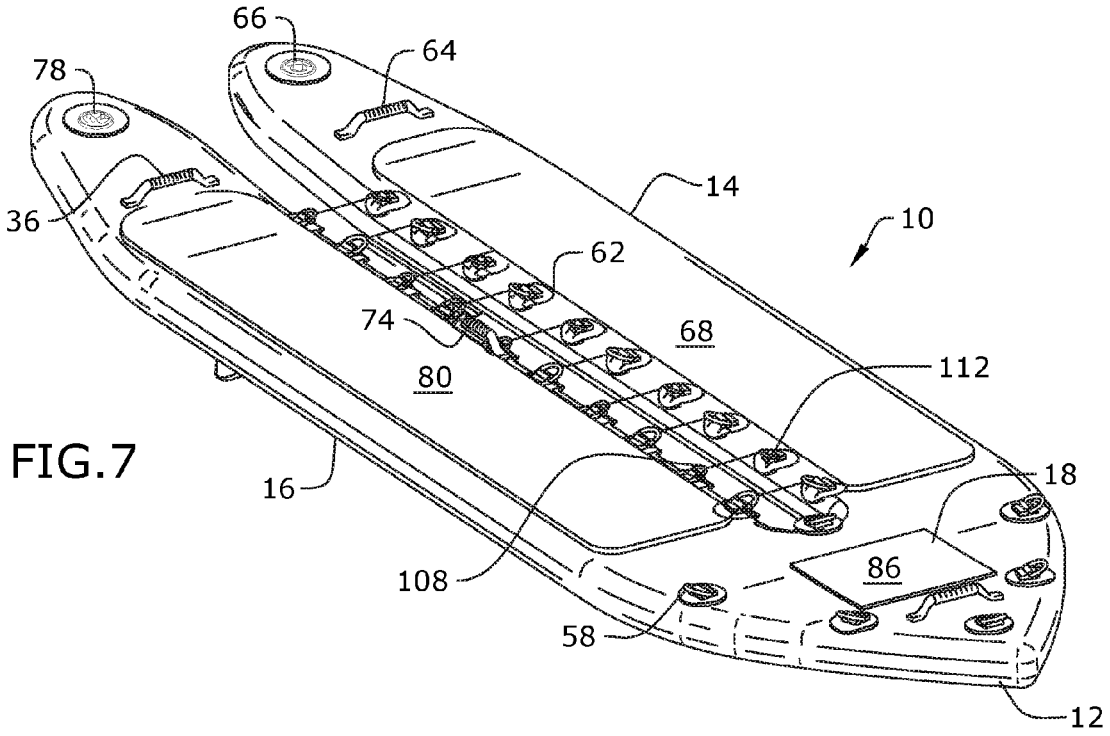
FIG. 7 shows a top perspective view of one embodiment of the present invention.
Figure 8:
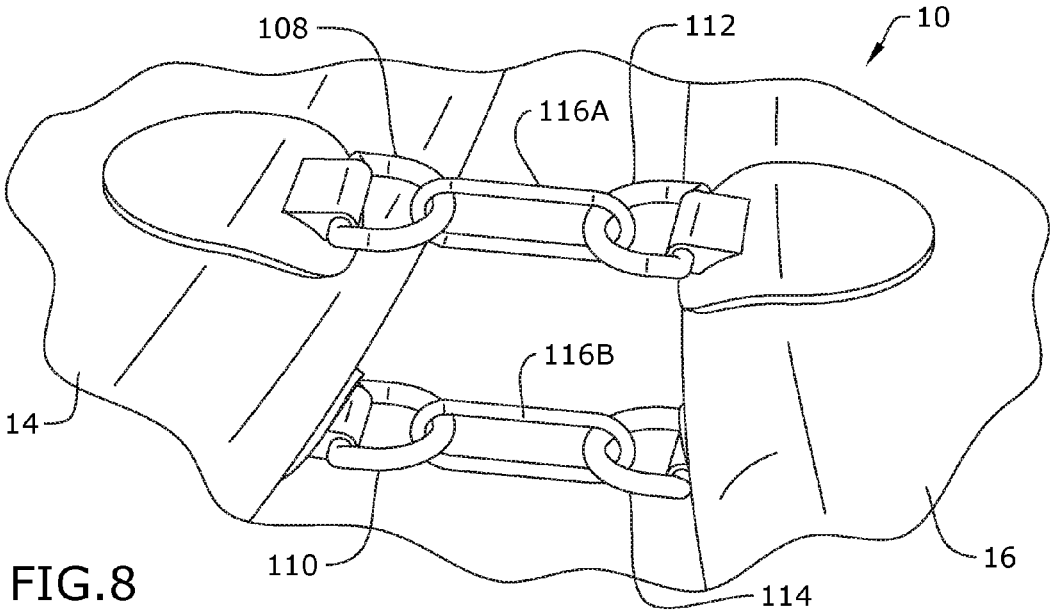
FIG. 8 shows a detail view of one embodiment of the present invention.

In some embodiments, port hull amidships side 32 is attached to upper port hull grommet flap 94 and lower port hull grommet flap 96. Starboard hull amidships side 40 can be attached to upper starboard hull grommet flap 98 and lower starboard hull grommet flap 100. Upper port hull grommet flap 94 is attached to upper starboard hull grommet flap 98 with upper hull string 102. Lower port hull grommet flap 96 is attached to lower starboard hull grommet flap 100 with lower hull string 104. As shown in FIG. 7, in some embodiments, cover 106 can be placed over port hull deck 68 and starboard hull deck 80 along with the space there between. This arrangement reduces, but does not eliminate, movement between the two hulls.

Figure 9:
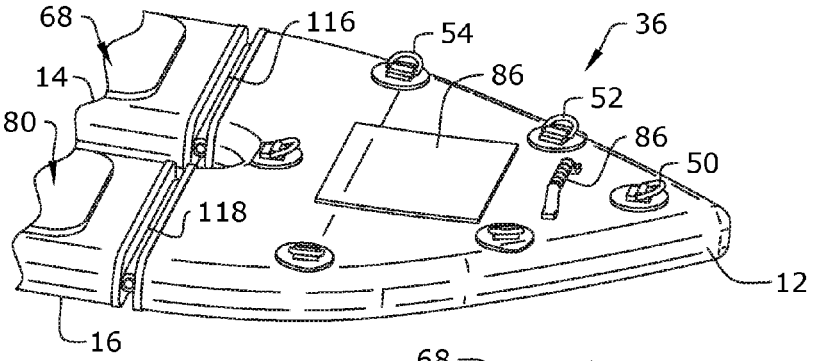
FIG. 9 shows a detail view of one embodiment of the present invention.

In FIG. 9, port hull 14 is attached to port hull upper amidships D-ring 108 and port hull lower amidships D-ring 110. Starboard hull 16 is attached to starboard hull upper amidships D-ring 112 and starboard hull lower amidships D-ring 114. First connection member 116A joins port hull upper amidships D-ring 108 and port hull lower amidships D-ring 110. Second connection member 116B starboard hull upper amidships D-ring 112, and starboard hull lower amidships D-ring 114.

Figure 10:
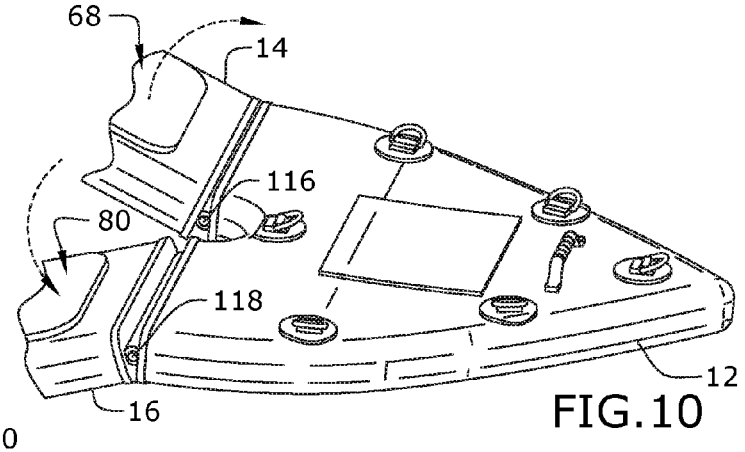
FIG. 10 shows a detail view of one embodiment of the present invention.

As shown in FIG. 9 and FIG. 10, bow 12 is attached to port hull 14 with port hull mechanical hinge 116. Bow 12 is attached to starboard hull 16 with starboard hull mechanical hinge 118.

Figure 11:
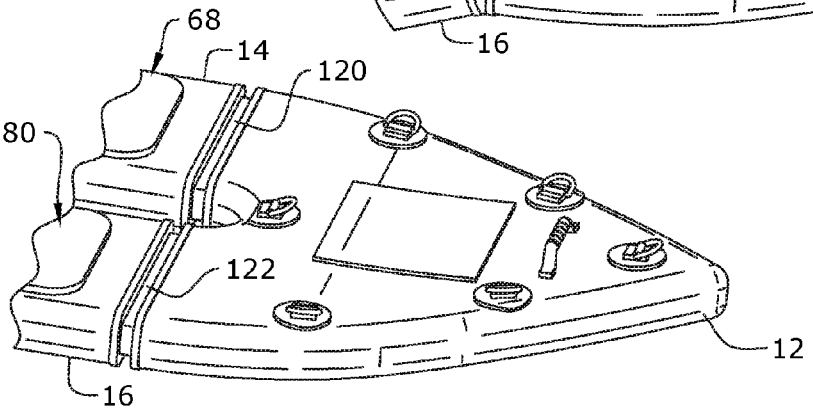
FIG. 11 shows a detail view of one embodiment of the present invention.
Figure 12:
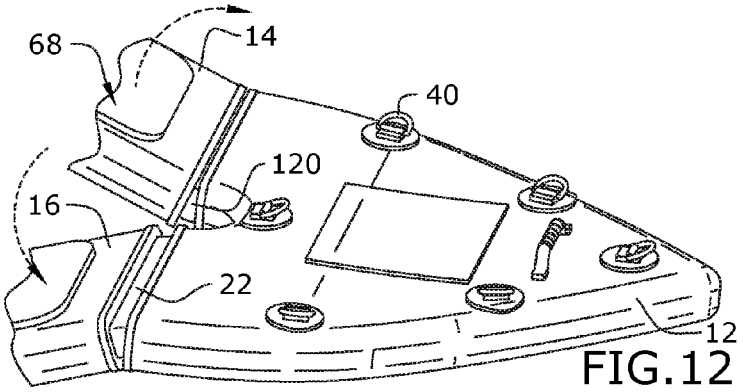
FIG. 12 shows a detail view of one embodiment of the present invention.
Figure 13:
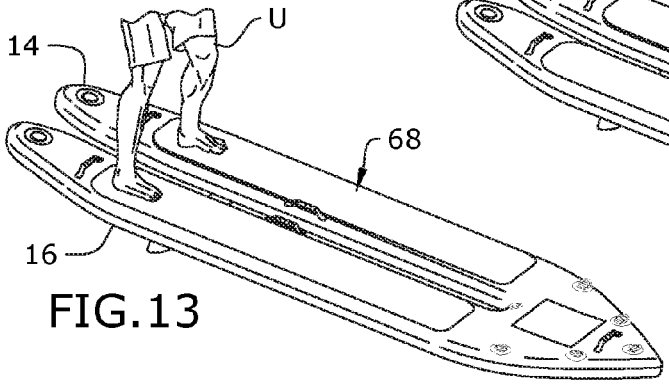
FIG. 13 a perspective view of one embodiment of the present invention shown in use.
Figure 14:
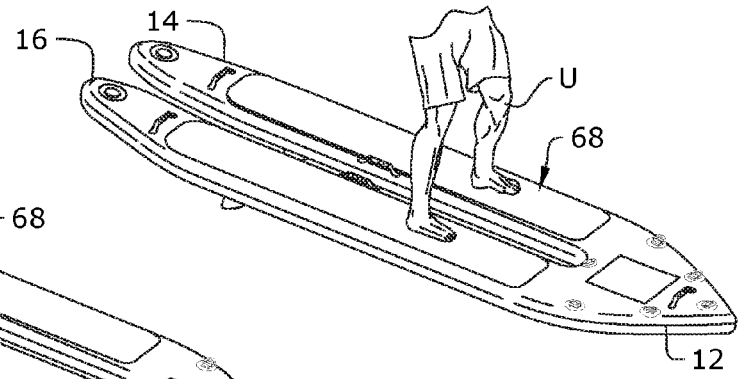
FIG. 14 a perspective view of one embodiment of the present invention shown in use.
Figure 15:
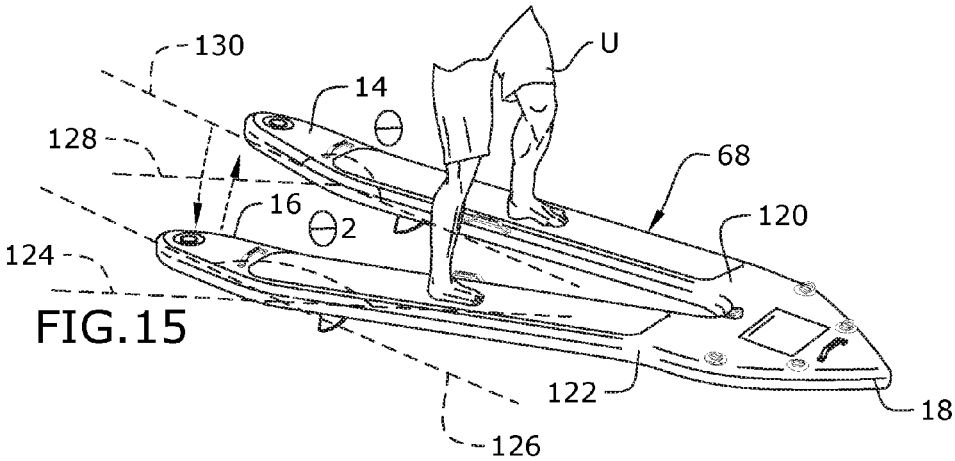
FIG. 15 a perspective view of one embodiment of the present invention shown in use.
Figure 16:
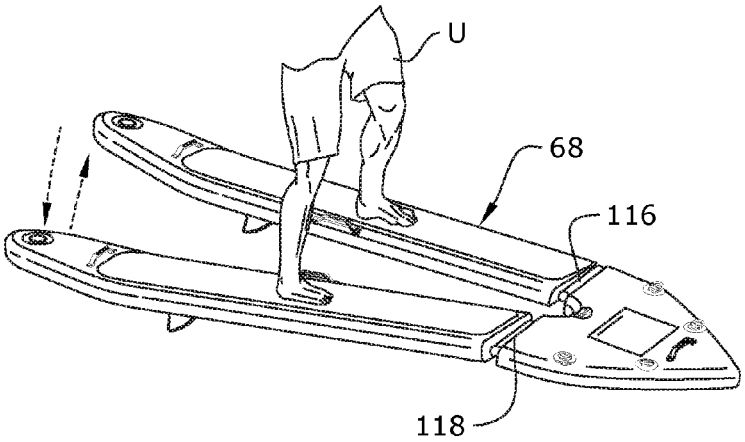
FIG. 16 a perspective view of one embodiment of the present invention shown in use.

As shown in FIG. 11 and FIG. 12, bow 12 is attached to port hull 14 with port hull live hinge 120. Bow 12 is attached to starboard hull 16 with starboard hull live hinge 122.

Turning to FIGS. 13-16, human user U can move legs to deflect port hull 14 and starboard hull 16 from bow 12. When a first port hull weight varies from a second port hull weight, the first port hull vertically deflects relative to the second port hull. For instance, variation of 100 pounds could cause a deflection of one inch which is shown in an exaggerated manner.

Port hull port side 28 is parallel to and collinear with port hull port side line 124. Port hull aft side 30 is parallel to and collinear with port hull aft side line 126. First angle θ1 can be measured counterclockwise from port hull port side line 124 to port hull aft side line 126. First angle θ1 can be at least 90 degrees, but no more than 180 degrees. Preferably, first angle θ1 is about 160 degrees.

Starboard hull starboard side 36 is parallel to and collinear with starboard hull starboard side line 128. Starboard hull aft side 38 is parallel to and collinear with starboard hull aft side line 130. First angle θ1 can be measured counterclockwise from starboard hull starboard side line 128 to starboard hull aft side line 130. Second angle θ2 can be at least 90 degrees, but no more than 180 degrees. Preferably, second angle θ2 is about 160 degrees.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A hull assembly, configured to transport a human user in water, the hull assembly comprising:

a bow, having a bow concave portion; wherein the bow further comprises a forward portion which is rounded on a port bow and a starboard bow while flat on a bow deck and a bow bottom side;

a port hull, joined to the bow; wherein the port hull is adopted to accommodate a first foot of the human user; wherein the port hull further comprises:

a port hull port side, extending from the port bow;

a port hull aft side, extending the port hull port side;

a port hull amidships side, extending from the port hull aft side; wherein the port hull amidships side is smoothly joined to the bow concave portion;

a port hull top side; and a port hull bottom side a starboard hull, joined to the bow and offset from the port hull by the bow concave portion; wherein the starboard hull is adapted to accommodate a second foot of the human user;

wherein when a first port hull weight varies from a second port hull weight, the port hull vertically deflects relative to the starboard hull.

2. The hull assembly of claim 1, further comprising:

a port hull amidships handle, a port hull aft handle, a port hull fill port and a port hull deck, attached to the port hull top side;

a port hull bottom side inboard fin and a port hull bottom side outboard fin, attached to the port hull bottom side.

3. The hull assembly of claim 2, wherein the starboard hull further comprises:

a starboard hull starboard side, extending from the starboard bow;

a starboard hull aft side, extending the starboard hull starboard side;

a starboard hull amidships side, extending from the starboard hull aft side; wherein the starboard hull amidships side is smoothly joined to the bow concave portion;

a starboard hull top side; and a starboard hull bottom side.

4. The hull assembly of claim 3, further comprising:

a starboard hull amidships handle, a starboard hull aft handle, a starboard hull fill port and a starboard hull deck, attached to the starboard hull top side;

a starboard hull bottom side inboard fin and starboard hull bottom side outboard fin, attached to the starboard hull bottom side.

5. The hull assembly of claim 4, further comprising:

port hull air, filling the port hull through the port hull fill port; and starboard hull air, filling the starboard hull through the starboard hull fill port.

6. The hull assembly of claim 3, further comprising:

an upper port hull grommet flap and a lower port hull grommet flap, attached to the port hull amidships side, an upper starboard hull grommet flap and a lower starboard hull grommet flap, attached to the starboard hull amidships side, an upper hull string, connected to the upper port hull grommet flap and the upper starboard hull grommet flap; and a lower hull string, connected to the lower port hull grommet flap and the lower starboard hull grommet flap wherein the upper hull string and the lower hull string operate to reduce movement of the port hull and the starboard hull.

7. The hull assembly of claim 3, further comprising:

a port hull upper amidships D-ring and a port hull lower amidships D-ring, attached to the port hull;

a starboard hull upper amidships D-ring and a starboard hull lower amidships D-ring, attached to the starboard hull; and a first connection member, joined to the port hull upper amidships D-ring and the starboard hull upper amidships D-ring, a second connection member, joined to the port hull lower amidships D-ring, and the starboard hull lower amidships D-ring.

8. A hull assembly, configured to transport a human user in water, the hull assembly comprising:

a bow, having a bow concave portion; wherein the bow further comprises a forward portion which is rounded on a port bow and a starboard bow while flat on a bow deck and a bow bottom side; wherein a bow forward d-ring, a bow forward port first d-ring, a bow forward port second d-ring, a bow forward starboard first d-ring, a bow forward starboard second d-ring, a bow handle, and a bow concave portion d-ring, are attached to the bow;

a port hull, joined to the bow; wherein the port hull is adopted to accommodate a first foot of the human user;

a starboard hull, joined to the bow and offset from the port hull by the bow concave portion; wherein the starboard hull is adapted to accommodate a second foot of the human user;

wherein when a first port hull weight varies from a second port hull weight, the port hull vertically deflects relative to the starboard hull.

9. The hull assembly of claim 8 wherein the port hull further comprises:

a port hull port side, extending from the port bow;

a port hull aft side, extending the port hull port side;

a port hull amidships side, extending from the port hull aft side; wherein the port hull amidships side is smoothly joined to the bow concave portion;

a port hull top side; and a port hull bottom side.

10. The hull assembly of claim 9, further comprising:

a port hull amidships handle, a port hull aft handle, a port hull fill port and a port hull deck, attached to the port hull top side;

a port hull bottom side inboard fin and a port hull bottom side outboard fin, attached to the port hull bottom side.

11. The hull assembly of claim 10, wherein the starboard hull further comprises:

a starboard hull starboard side, extending from the starboard bow;

a starboard hull aft side, extending the starboard hull starboard side;

a starboard hull amidships side, extending from the starboard hull aft side; wherein the starboard hull amidships side is smoothly joined to the bow concave portion;

a starboard hull top side; and a starboard hull bottom side.

12. The hull assembly of claim 11, further comprising:

a starboard hull amidships handle, a starboard hull aft handle, a starboard hull fill port and a starboard hull deck, attached to the starboard hull top side;

a starboard hull bottom side inboard fin and starboard hull bottom side outboard fin, attached to the starboard hull bottom side.

13. The hull assembly of claim 12, further comprising:

port hull air, filling the port hull through the port hull fill port; and starboard hull air, filling the starboard hull through the starboard hull fill port.

14. The hull assembly of claim 12, further comprising:

a upper port hull grommet flap and a lower port hull grommet flap, attached to the port hull amidships side, a upper starboard hull grommet flap and a lower starboard hull grommet flap, attached to the starboard hull amidships side, a upper hull string, connected to the upper port hull grommet flap and the upper starboard hull grommet flap; and a lower hull string, connected to the lower port hull grommet flap and the lower starboard hull grommet flap wherein the upper hull string and the lower hull string operate to reduce movement of the port hull and the starboard hull.

15. The hull assembly of claim 12, further comprising:

a port hull upper amidships D-ring and a port hull lower amidships D-ring, attached to the port hull;

a starboard hull upper amidships D-ring and a starboard hull lower amidships D-ring, attached to the starboard hull; and a first connection member, joined to the port hull upper amidships D-ring and the starboard hull upper amidships D-ring, a second connection member, joined to the port hull lower amidships D-ring, and the starboard hull lower amidships D-ring.

* * * * *